US011635087B1

(12) United States Patent
Chien

(10) Patent No.: US 11,635,087 B1
(45) Date of Patent: Apr. 25, 2023

(54) AIRFLOW-DOUBLING VANE STRUCTURE

(71) Applicant: YUAN FANG APPLIED MATERIALS CO., LTD, Zhubei (TW)

(72) Inventor: Wen-Cheng Chien, Hsinchu (TW)

(73) Assignee: YUAN FANG APPLIED MATERIALS CO., LTD, Hsinchu County (TW)

( * ) Notice: Subject to any disclaimer, the term of this patent is extended or adjusted under 35 U.S.C. 154(b) by 0 days.

(21) Appl. No.: 17/552,794

(22) Filed: Dec. 16, 2021

(30) Foreign Application Priority Data

Nov. 19, 2021 (TW) ..... 110143184

(51) Int. Cl.

| | |
|---|---|
| ***F04D 17/02*** | (2006.01) |
| ***F04D 29/28*** | (2006.01) |
| ***F04D 17/16*** | (2006.01) |
| ***F04D 19/00*** | (2006.01) |
| ***F04D 29/32*** | (2006.01) |
| ***F04D 29/38*** | (2006.01) |
| ***F04D 29/30*** | (2006.01) |

(52) U.S. Cl.
CPC ..... *F04D 29/281* (2013.01); *F04D 17/16* (2013.01); *F04D 19/002* (2013.01); *F04D 29/30* (2013.01); *F04D 29/325* (2013.01); *F04D 29/384* (2013.01); *F04D 17/025* (2013.01); *F05D 2240/30* (2013.01)

(58) Field of Classification Search
CPC ..... F04D 17/05; F04D 17/02; F04D 17/12; F04D 29/28–283; F04D 29/32–329; F04D 29/26; F04D 19/002; F04D 19/007
See application file for complete search history.

(56) References Cited

U.S. PATENT DOCUMENTS 7,051,791 B2 * 5/2006 Hashimoto ..... F04D 29/30 257/E23.099
7,458,415 B2 * 12/2008 Hashimoto ..... F04D 17/16 165/104.34
10,369,749 B2 * 8/2019 Tsurugai ..... B29C 66/612
10,378,551 B2 * 8/2019 Vo ..... F02C 3/08
(Continued)

FOREIGN PATENT DOCUMENTS

CN 2414234 Y * 1/2001
CN 102635571 A * 8/2012
WO WO-2014117288 A1 * 8/2014 ..... F04D 17/025

OTHER PUBLICATIONS

CN-2414234—Translation from Espacenet (Year: 2001).*
CN-102635571—Translation from Espacenet (Year: 2012).*
WO-2014117288—Translation from Espacenet (Year: 2014).*

*Primary Examiner* — J. Todd Newton
*Assistant Examiner* — Behnoush Haghighian
(74) *Attorney, Agent, or Firm* — Winston Hsu

(57) ABSTRACT

An airflow-doubling vane structure includes an axle, an inner vane unit, and an outer vane unit. The inner vane unit includes a plurality of vanes provided around a center defined by the axle and can be rotated along with the axle. The vanes of the inner vane unit are centrifugal vanes. The outer vane unit includes a plurality of vanes provided around the center defined by the axle and around the inner vane unit and can be rotated along with the axle. The vanes of the outer vane unit are axial-flow vanes and extend a certain radial distance from the vanes of the inner vane unit.

6 Claims, 8 Drawing Sheets

(56) References Cited

U.S. PATENT DOCUMENTS

| | | | | |
|---|---|---|---|---|
| 11,187,238 | B2 * | 11/2021 | Yamamoto | F04D 29/329 |
| 2004/0076515 | A1 * | 4/2004 | Hsieh | F04D 29/329<br>415/199.6 |
| 2008/0247874 | A1 * | 10/2008 | Acre | F04D 29/646<br>416/95 |
| 2013/0259667 | A1 * | 10/2013 | Huang | F04D 25/06<br>415/185 |
| 2017/0074280 | A1 * | 3/2017 | Vo | F02C 3/08 |
| 2019/0022954 | A1 * | 1/2019 | Tsurugai | B29C 66/322 |
| 2020/0248700 | A1 * | 8/2020 | Potratz | F04D 29/281 |

* cited by examiner

AIRFLOW-DOUBLING VANE STRUCTURE

BACKGROUND OF THE INVENTION

1. Technical Field

The present invention relates to a vane structure and more particularly to an airflow-doubling vane structure.

2. Description of Related Art

Vane structures can be generally divided into two different types: axial-flow vanes and centrifugal vanes. Axial-flow vanes, such as the vanes of a common household electric fan, refer to a configuration in which the airflow direction is perpendicular to the vane wheel. This type of vanes is effective in propelling air forward but does not provide satisfactory suction. Centrifugal vanes, such as the vanes of a common blower or turbine, refer to a configuration in which an airflow is drawn in through the center of the vane wheel and then moves in a radiating manner toward, and outward of, the vane wheel. This type of vanes features advantageously strong suction, can generate an airflow toward the vane wheel, but is not effective in propelling the airflow forward. The two types of vanes are generally used separately, without their respective advantages combined.

BRIEF SUMMARY OF THE INVENTION

The primary objective of the present invention is to provide an airflow-doubling vane structure that incorporates two different types of vane structures to produce a composite airflow.

To achieve the primary objective, the airflow-doubling vane structure of the present invention includes an axle, an inner vane unit, and an outer vane unit. The inner vane unit includes a plurality of vanes that are provided around a center defined by the axle, and the inner vane unit can be rotated along with the axle. The vanes of the inner vane unit are centrifugal vanes. The outer vane unit includes a plurality of vanes that are provided around the center defined by the axle and around the inner vane unit. The vanes of the outer vane unit are axial-flow vanes, and the outer vane unit can be rotated along with the axle. The outer vane unit extends in radial directions of the inner vane unit.

Preferably, each vane of the inner vane unit has a width in the axial direction, and each vane of the outer vane unit extends a radial distance ranging from one to five times the aforesaid width.

Preferably, each of the plurality of vanes of the outer vane unit has a first connecting portion, a second connecting portion, and a hollow portion formed between the first connecting portion and the second connecting portion.

Preferably, the inner vane unit and the outer vane unit are driven into rotation by two different power sources respectively, and the axis around which the inner vane unit is rotated and the axis around which the outer vane unit is rotated coincide.

It can be known from the structures described above that the airflow-doubling vane structure of the present invention can achieve the objective of the invention.

The structural details, features, and method of assembly or use of the present invention will be described below with reference to some embodiments of the invention. As would be understood by a person of ordinary skill in the art, the following detailed description and the specific embodiments disclosed herein serve only to expound, but not to limit, the scope of the invention, which scope is defined by the appended claims.

DETAILED DESCRIPTION OF THE INVENTION

Figure 1:
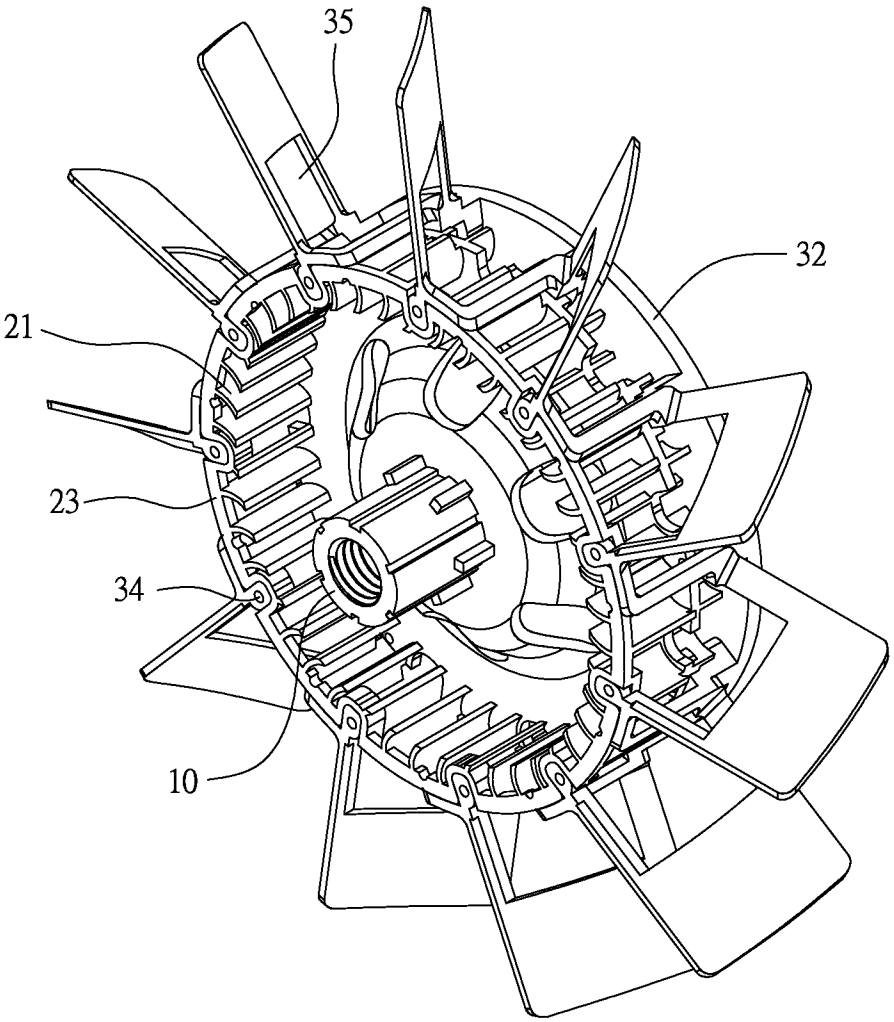
FIG. 1 is a perspective view of the first embodiment of the present invention.
Figure 2:
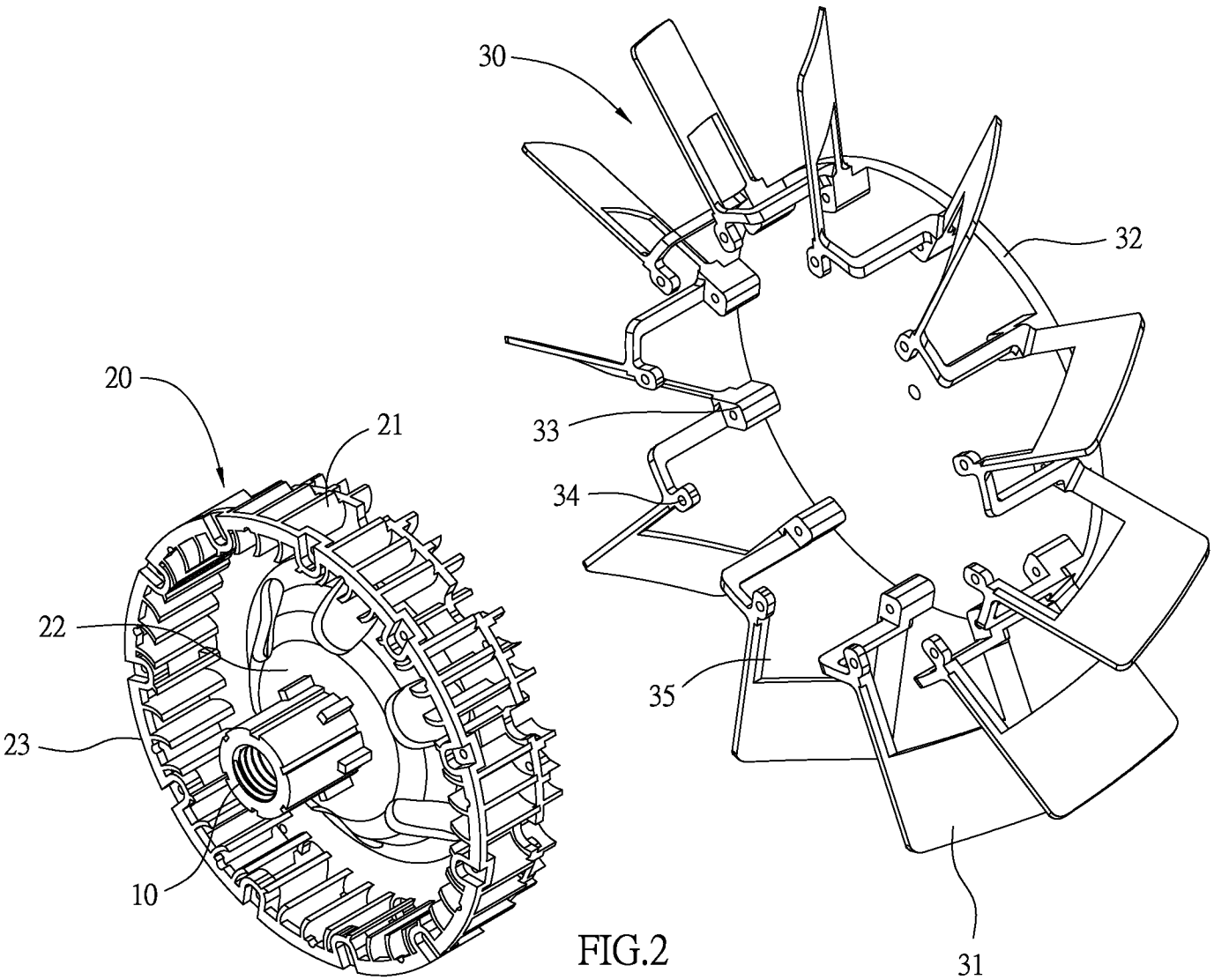
FIG. 2 is an exploded view of the first embodiment of the invention.
Figure 3:
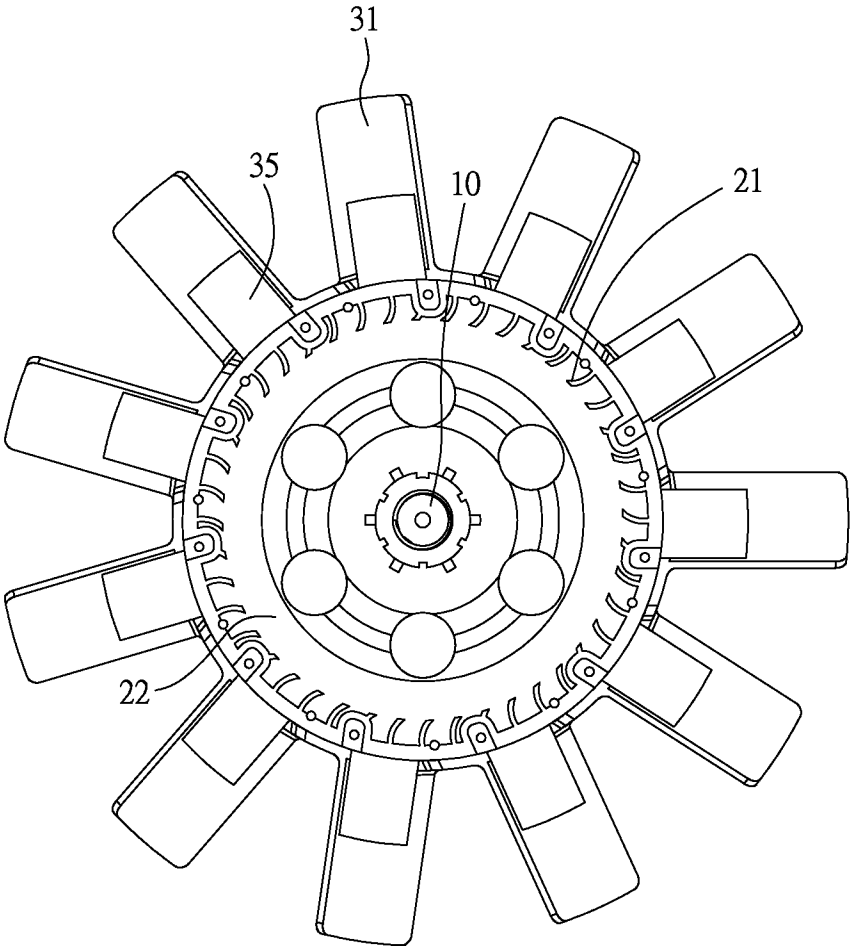
FIG. 3 is a front view of the first embodiment of the invention.
Figure 4:
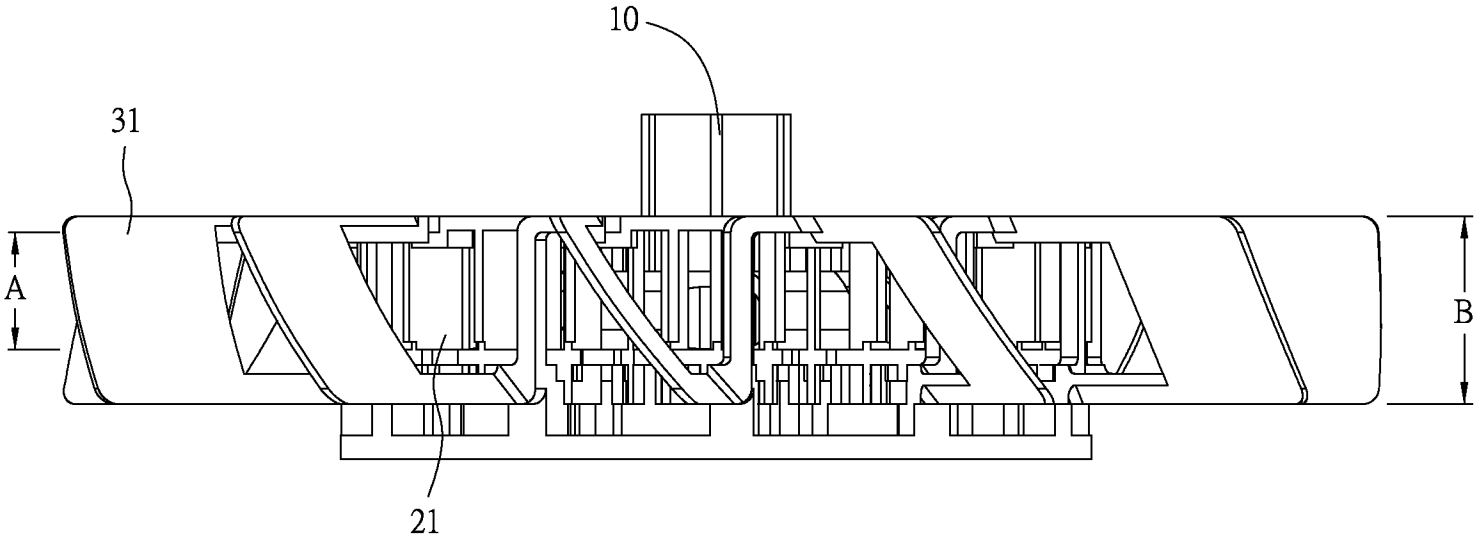
FIG. 4 is a side view of the first embodiment of the invention.

To start with, the applicant wishes to point out that all the directional terms used in the following description of embodiments and in the claims refer to the directions in the drawings, and that the same reference numerals are used in the following description of embodiments and in the drawings to designate the same, or a similar, element or structural feature.

Referring to FIG. 1 to FIG. 4 for the first embodiment of the present invention, the airflow-doubling vane structure of the invention includes an axle 10, an inner vane unit 20, and an outer vane unit 30.

The axle 10 is configured to be provided on and rotated by a rotating power source. For example, the axle 10 can be provided on the rotating shaft of a motor in order for the rotating shaft to drive the axle 10 into rotation.

The inner vane unit 20 includes a plurality of vanes 21 that are connected to, and provided around a center defined by, the axle 10, and the inner vane unit 20 can be rotated along with the axle 10. Each vane 21 has a width A in the axial direction. The vanes 21 of the inner vane unit 20 are centrifugal vanes, such as the vanes of a common blower or turbine, and can draw an airflow into the inner vane unit 20 through the center of the inner vane unit 20 and drive the airflow outward in a radiating manner in radial directions of the inner vane unit 20. In this embodiment, the vanes 21 of the inner vane unit 20 are blower vanes by way of example, and the inner vane unit 20 further includes a disc-shaped base portion 22 coupled to the axle 10. The vanes 21 are provided on the outer periphery of the base portion 22. Each vane 21 is provided with a curved section extending generally along a radial direction of the axle 10. An upper ring 23 is provided at one end of the vanes 21 to connect the vanes 21.

The outer vane unit 30 includes a plurality of vanes 31 that are provided around the inner vane unit 20 as well as around the center defined by the axle 10. The vanes 31 of the outer vane unit 30 extend in radial directions of the inner vane unit 20 for a radial distance ranging from one to ten times, preferably one to five times, the width A of each inner vane 21. Each vane 31 of the outer vane unit 30 has a width B in the axial direction. The width B may be greater than, equal to, or less than the width A of each inner vane 21. The vanes 31 of the outer vane unit 30 are axial-flow vanes and can propel an airflow forward. In this embodiment, the outer vane unit 30 further includes a circular base part 32 provided on one side of the inner vane unit 20. Each of the plurality of vanes 31 has a first connecting portion 33 and a second connecting portion 34, is connected to the base part 32 through the first connecting portion 33, and is connected to the upper ring 23 of the inner vanes 21 through the second connecting portion 34. In addition, a hollow portion 35 is formed between the first connecting portion 33 and the second connecting portion 34 of each vane 31 to make it easier for air to flow from the inner vane unit 20 outward to the outer vane unit 30.

The first embodiment is so designed that the inner vane unit 20 and the outer vane unit 30 are rotated in unison. During rotation, the centrifugal vanes 21 of the inner vane unit 20 generate a relatively great suction force to draw air toward the inner vane unit 20, and the air flows radially outward, i.e., in a radiating manner, to the outer vane unit 30, which is provided around the inner vane unit 20, in order for the axial-flow vanes 31 of the outer vane unit 30 to propel the air forward along the axial direction of the axle 10. Thus, the advantages of two different types of vanes are combined to increase the intensity and smoothness of the resulting airflow.

Figure 5:
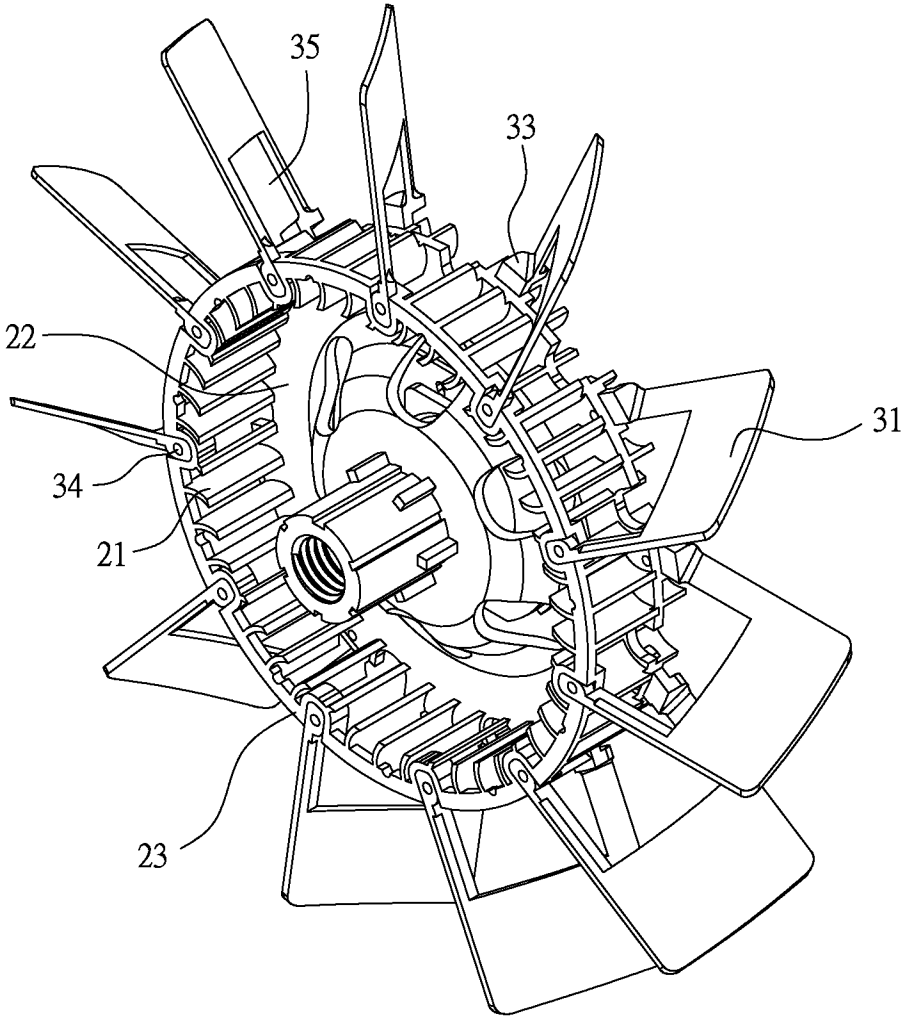
FIG. 5 is a perspective view of the second embodiment of the invention.

Referring to FIG. 5, the second embodiment of the present invention is similar to the first embodiment in including an axle 10, an inner vane unit 20, and an outer vane unit 30, with the outer vane unit 30 including a plurality of vanes 31 each having a first connecting portion 33 and a second connecting portion 34. In the second embodiment, however, each vane 31 of the outer vane unit 30 is connected to the base portion 22 of the inner vane unit 20 through the corresponding first connecting portion 33 and to the upper ring 23 of the inner vane unit 20 through the corresponding second connecting portion 34, for unlike its counterpart in the first embodiment, the outer vane unit 30 in the second embodiment is not provided with the base part 32. While such a structure takes more time and labor to assemble, the effect of using two different types of vanes at the same time can nevertheless be achieved.

Figure 6:
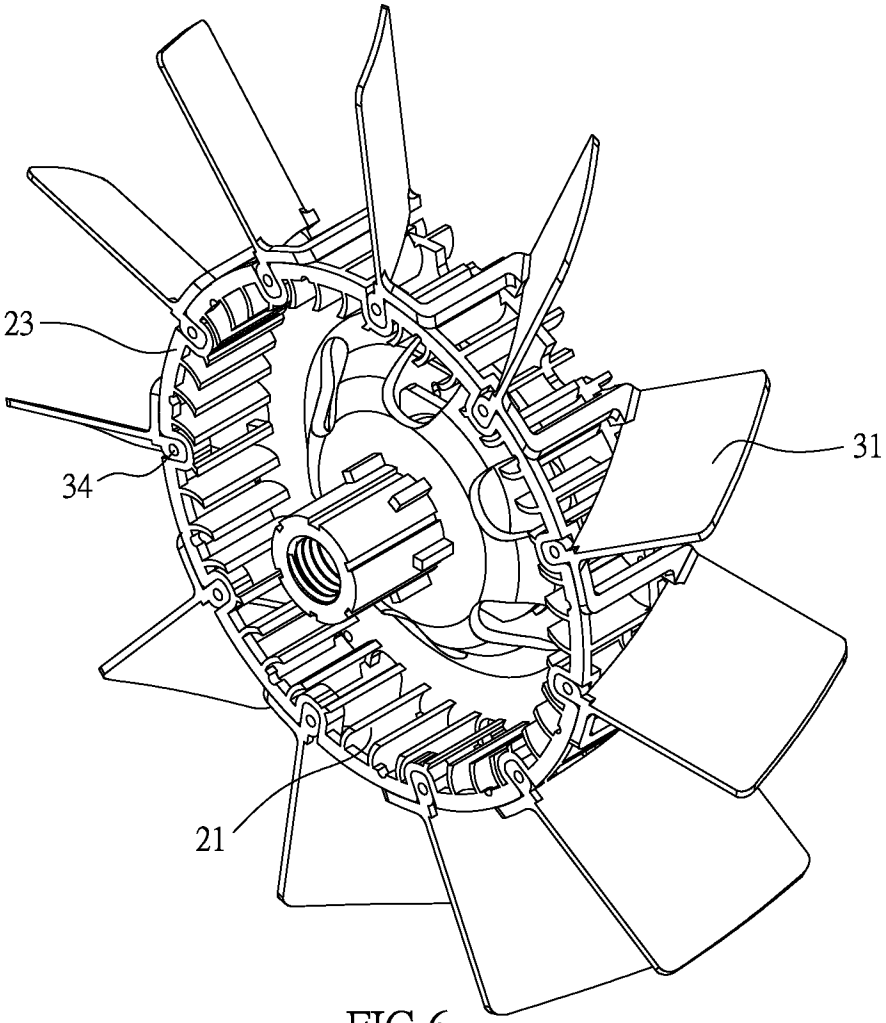
FIG. 6 is a perspective view of the third embodiment of the invention.

Referring to FIG. 6, the third embodiment of the present invention is structurally similar to the second embodiment in that the vanes 31 of the outer vane unit 30 are connected to the base portion 22 and the upper ring 23 of the inner vane unit 20. The third embodiment, however, is different from the second embodiment in that the vanes 31 of the outer vane unit 30 do not have the hollow portion 35 formed between each pair of first and second connecting portions 33 and 34.

In the foregoing three embodiments, the inner vane unit 20 and the outer vane unit 30 are either directly or indirectly connected to the axle 10, and the axle 10 is to be connected to, and rotated by, an external power source so that the inner vane unit 20 and the outer vane unit 30 are rotated simultaneously and synchronously.

Figure 7:
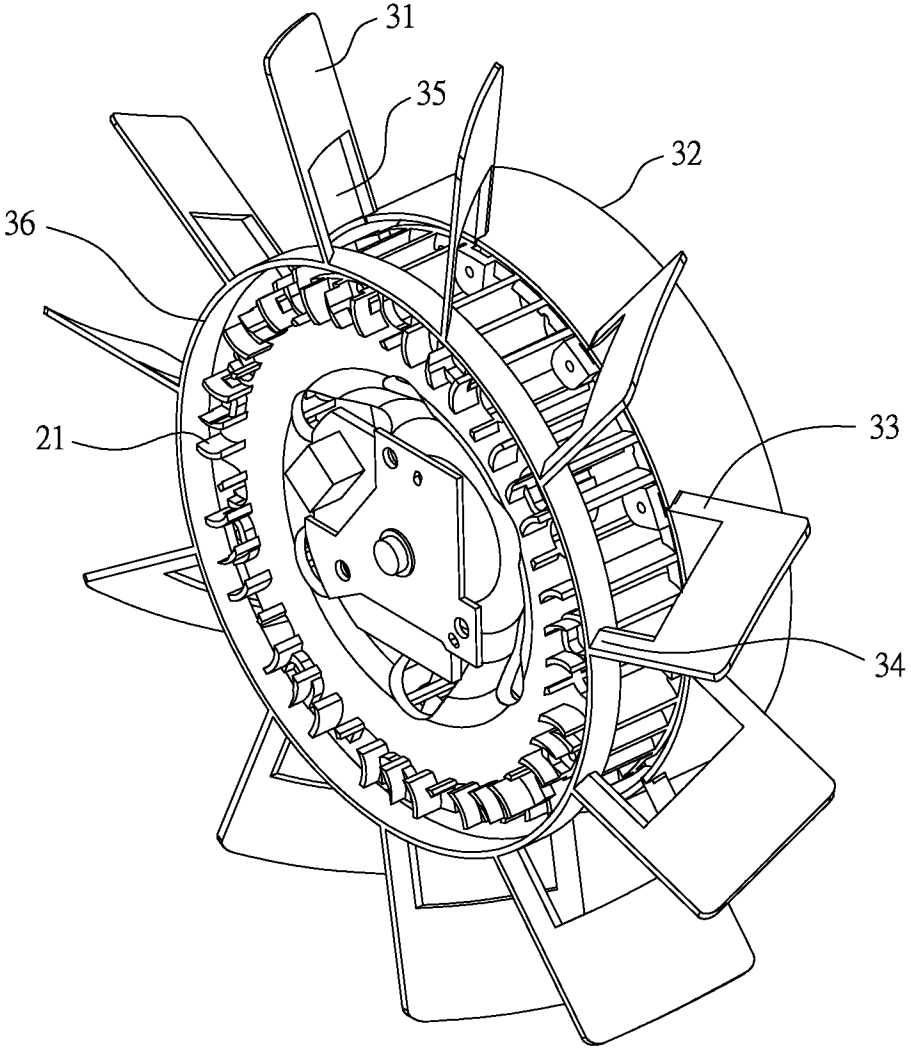
FIG. 7 is a perspective view of the fourth embodiment of the invention.
Figure 8:
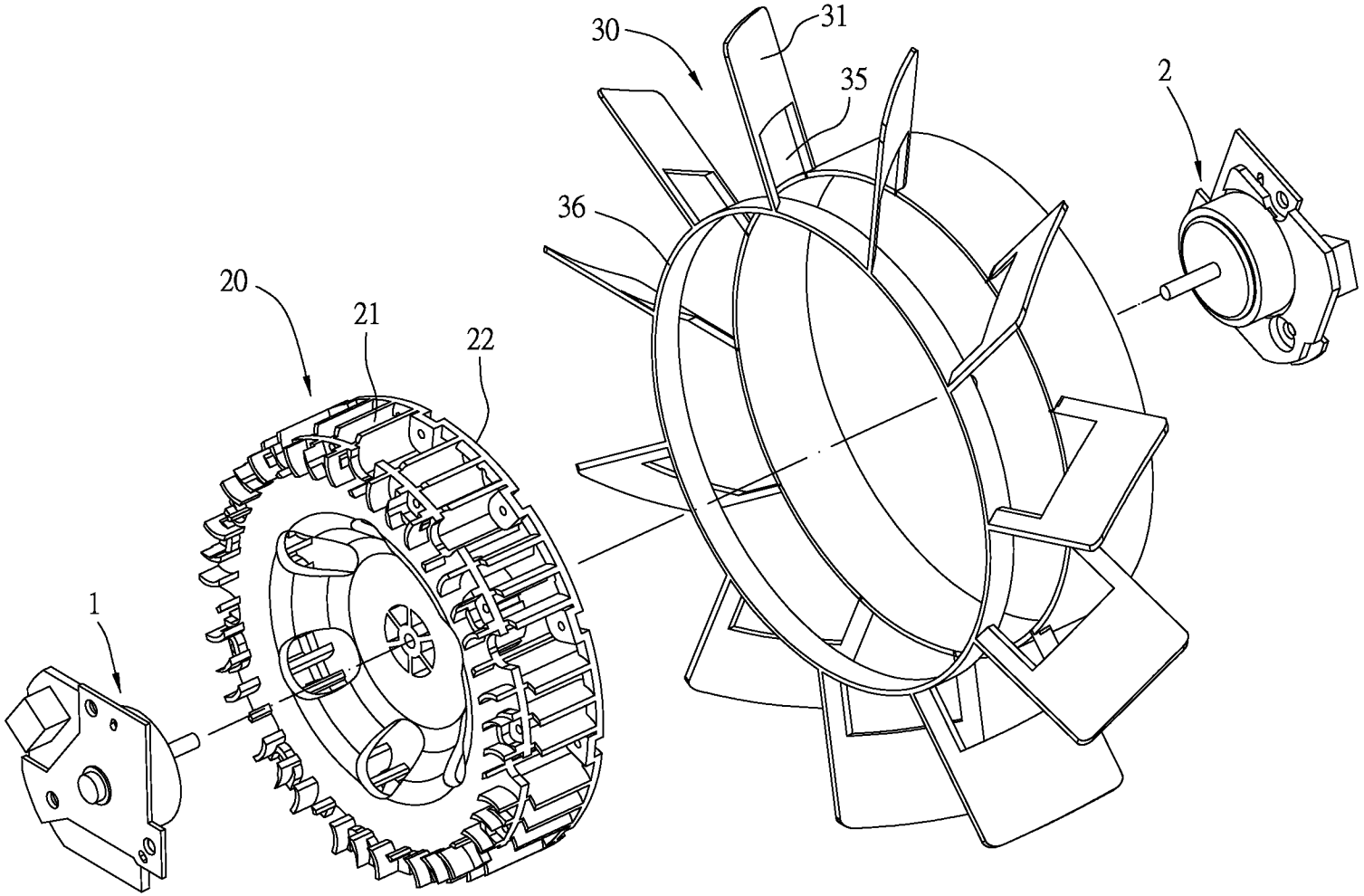
FIG. 8 is an exploded view of the fourth embodiment of the invention.

In the fourth embodiment of the present invention, referring to FIG. 7 and FIG. 8, the airflow-doubling vane structure includes an axle 10, an inner vane unit 20, and an outer vane unit 30.

The axle 10 is configured to be provided on and rotated by a rotating first power source 1.

The inner vane unit 20 includes a plurality of vanes 21 that are connected to, and provided around a center defined by, the axle 10, and the inner vane unit 20 can be rotated along with the axle 10. Each vane 21 has a width A in the axial direction. The vanes 21 of the inner vane unit 20 are centrifugal vanes and can draw an airflow into the inner vane unit 20 through the center of the inner vane unit 20 and drive the airflow outward in a radiating manner in radial directions of the inner vane unit 20.

The outer vane unit 30 includes a base part 32, and a plurality of vanes 31 are provided around the base part 32. The base part 32 is configured to be connected to and rotated by a second power source 2. As in the previous embodiments, the outer vane unit 30 is provided around the inner vane unit 20, with the vanes 31 extending in radial directions of the inner vane unit 20 for a radial distance preferably equal to the axial width A of each inner vane 21. The axis around which the inner vane unit 20 is rotated and the axis around which the outer vane unit 30 is rotated coincide. The base part 32 is circular. Each of the plurality of vane 31 has a first connecting portion 33 and a second connecting portion 34, is connected to the base part 32 through the first connecting portion 33, and is connected to an outer ring 36 through the second connecting portion 34. In addition, a hollow portion 35 is formed between the first connecting portion 33 and the second connecting portion 34 of each vane 31 to make it easier for air to flow from the inner vane unit 20 outward to the outer vane unit 30.

The fourth embodiment is different from the previous three embodiments in that the inner vane unit 20 and the outer vane unit 30 are driven by two different power sources respectively. During rotation, therefore, the rotation speed of the inner vane unit 20 may be the same as or different from that of the outer vane unit 30 in order to produce a more desirable airflow.

What is claimed is:

1. An airflow-doubling vane structure, comprising:

an axle configured to be provided on and rotated by a rotating power source;

an inner vane unit comprising a plurality of vanes connected to, and provided around a center defined by, the axle, the inner vane unit being rotatable along with the axle, each said vane of the inner vane unit having a width in an axial direction, the vanes of the inner vane unit being centrifugal vanes, the inner vane unit further comprising a disc-shaped base portion coupled to the axle, and the vanes of the inner vane unit being provided on an outer periphery of the base portion such that an airflow is able to be drawn into the inner vane unit and then move outward in a radiating manner in radial directions of the inner vane unit; and an outer vane unit comprising a plurality of vanes provided around the center defined by the axle and around the inner vane unit, the vanes of the outer vane unit extending in radial directions of the inner vane unit for a radial distance ranging from one to ten times the width of each said vane of the inner vane unit, and the vanes of the outer vane unit being axial-flow vanes in order to propel the airflow forward, and a hollow portion is formed on each of the vanes of the outer vane unit.

2. The airflow-doubling vane structure of claim 1, wherein the radial distance for which the vanes of the outer vane unit extend in said radial directions of the inner vane unit ranges from one to five times the width of each said vane of the inner vane unit.

3. The airflow-doubling vane structure of claim 2, wherein an upper ring is provided at one end of the vanes of the inner vane unit to connect the vanes of the inner vane unit.

4. The airflow-doubling vane structure of claim 3, wherein each said vane of the outer vane unit has a first connecting portion and a second connecting portion, is connected to the base portion of the inner vane unit through the first connecting portion, and is connected to the upper ring through the second connecting portion.

5. The airflow-doubling vane structure of claim 4, wherein said hollow portion is formed between the first connecting portion and the second connecting portion.

6. The airflow-doubling vane structure of claim 1, wherein said each of the hollow portion is communicated to the space outside the inner vane unit.

* * * * *